US007413004B2

(12) United States Patent
Okonski, Sr. et al.

(10) Patent No.: US 7,413,004 B2
(45) Date of Patent: Aug. 19, 2008

(54) HIGH-EFFICIENCY ENHANCED BOILER

(76) Inventors: John E. Okonski, Sr., 2323 Alton St., Niskayuna, NY (US) 12309; John E. Okonski, Jr., 2122 Primrose La., Niskayuna, NY (US) 12309

( * ) Notice: Subject to any disclaimer, the term of this patent is extended or adjusted under 35 U.S.C. 154(b) by 0 days.

(21) Appl. No.: 11/276,368

(22) Filed: Feb. 27, 2006

(65) Prior Publication Data

US 2007/0199688 A1 Aug. 30, 2007

(51) Int. Cl.
*F28D 7/10* (2006.01)
*F28F 1/42* (2006.01)

(52) U.S. Cl. ..... 165/163; 165/179

(58) Field of Classification Search ..... 165/142, 165/157, 162, 163, 178, 179, 181, 184
See application file for complete search history.

(56) References Cited

U.S. PATENT DOCUMENTS

| | | | | | |
|---|---|---|---|---|---|
| 166,461 | A | * | 8/1875 | Houghton | 165/179 |
| 2,004,252 | A | * | 6/1935 | Sorensen | 165/137 |
| 2,872,164 | A | * | 2/1959 | Wilson | 165/163 |
| 2,893,705 | A | * | 7/1959 | Fennel | 165/146 |
| 3,474,636 | A | * | 10/1969 | Bligh | 165/163 |
| 3,785,350 | A | | 1/1974 | McCormick | |
| 3,788,281 | A | | 1/1974 | Van Lookeren Campagne | |
| 3,835,816 | A | | 9/1974 | Ferrin | |
| 3,987,761 | A | | 10/1976 | Downs et al. | |
| 4,055,152 | A | | 10/1977 | Vidaleng | |
| 4,116,270 | A | * | 9/1978 | Marushkin et al. | 165/162 |
| 4,623,309 | A | * | 11/1986 | Teigen | 431/170 |
| 6,167,846 | B1 | | 1/2001 | Ogino et al. | |
| 2001/0018962 | A1 | * | 9/2001 | Joshi et al. | 165/163 |

* cited by examiner

*Primary Examiner*—Teresa J Walberg
(74) *Attorney, Agent, or Firm*—Stephen F. Swinton, Jr.; Hoffman Warnick LLC

(57) ABSTRACT

In devices known in the art, "conventional firetube" and "waste heat recovery" boilers each require many small tubes making successive passes within the boiler. In one embodiment of the invention, however, an enhanced conduit replaces numerous conventional small tubes. In some embodiments, the enhanced conduit incorporates a plurality of fins, each of which extends through a wall of the conduit. In other embodiments, the enhanced conduit incorporates a plurality of tubes along its outer surface, through which a heat transfer medium flows. Both designs enhance the heat transfer relationship between the hot fluid and the heat transfer medium by providing a continuous heat transfer relationship with the heat transfer medium, increasing the surface area involved in the heat transfer relationship and enhancing convection/conduction couples. For some applications, all of the tube banks of other devices in the art can be replaced by one continuous enhanced conduit.

12 Claims, 12 Drawing Sheets

350
365A
360A
368B
362B
366A
368A
362A
367A
369A
363A

HIGH-EFFICIENCY ENHANCED BOILER

CROSS-REFERENCE TO RELATED APPLICATIONS

The current application claims the benefit of PCT Patent Application No. PCT/US2004/027812, filed Aug. 27, 2004, and U.S. Provisional Application No. 60/498,486 filed Aug. 28, 2003, which are hereby incorporated herein by reference.

BACKGROUND OF THE INVENTION (1) Technical Field

The present invention relates generally to a heat exchanger, and more specifically to a "direct-fired" or "indirect-fired" boiler for generating steam, hot water, hot oil, and hot molten metals.

(2) Related Art

All boilers operate according to the physical sciences of thermodynamics and heat transfer. Essentially, forced hot gas is cooled within the boiler by transferring heat to a heat transfer medium, often water, to generate steam or hot water. Depending upon system requirements, direct-fired boilers and/or indirect-fired boilers are commonly placed in service to produce steam and hot water. In the case of a direct-fired boiler, a fueled burner or combustor is fired into the boiler, generating heat within the boiler itself. The fueled burner establishes a flame, producing a hot fluid, which is in heat transfer relation with a cooler heat transfer medium. A temperature differential between the hot fluid and the heat transfer medium drives the heat transfer process by way of conduction, convection, and radiation.

In a similar manner, a "waste heat recovery" or indirect-fired boiler makes use of residual heat from an isolated thermodynamic process. However, radiation heat transfer is a less significant heat transfer mechanism for the indirect-fired boiler. For boilers of either direct-fired or indirect-fired construction, the heat transfer medium is usually water and/or steam, due in large part to their widespread availability and substantial heat capacity. Another advantage of water/steam heat transfer media is that it presents no imminent environmental threat.

A conventional type of direct-fired boiler, commonly called a "firetube" boiler, employs a fueled burner to generate heat. The burner is fired into a single main tube, called the firetube. This firetube absorbs the majority of the radiation emitted from the combustion process. In addition, convective/conductive couples drive heat transfer between the hot fluid and the heat transfer medium throughout the device. Conventional firetube boilers typically contain one to three additional banks of significantly smaller tubes, called passes. For example, a firetube boiler design that includes two banks of tubes in addition to the firetube is termed a "three-pass firetube boiler," elicited from the path of the hot fluid. The course of flow for the "three-pass firetube boiler" occurs after the fueled burner generates hot gas inside the firetube, which is then driven through a first bank of smaller tubes flowing opposite the firetube, and then diverted through a second bank of smaller tubes flowing parallel to the firetube. A channel, called the "turn-around pass," is located between each pass, wherein the hot gas reverses direction. The hot gas cools while flowing through the tube passes of the firetube boiler by transferring energy to the heat transfer medium. For either design, all tube banks, less the "turn-around pass," are in heat transfer relationship with the heat transfer medium. In a similar manner, although a "waste heat recovery" or indirect-fired boiler does not require a firetube, the hot gas does flow sequentially from tube bank to tube bank as required to enact the heat transfer. As a result, heat transfer to the heat transfer medium is largely dependent upon the total length of the tubes it contacts. This can result in larger and more expensive devices.

Accordingly, a need exists for a heat exchange device capable of greater efficiency in the transfer of heat from its fluid to its heat transfer medium.

SUMMARY OF THE INVENTION

In devices known in the art, "conventional firetube" and "waste heat recovery" boilers each require many small tubes making successive passes within the boiler. In one embodiment of the invention, however, an enhanced conduit replaces numerous conventional small tubes. In some embodiments, the enhanced conduit incorporates a plurality of fins, each of which extends through a wall of the conduit. In other embodiments, the enhanced conduit incorporates a plurality of tubes along its inner surface, through which a heat transfer medium flows. Both designs enhance the heat transfer relationship between the hot fluid and the heat transfer medium by providing a continuous heat transfer relationship with the heat transfer medium, increasing the surface area involved in the heat transfer relationship and enhancing convection/conduction couples. For some applications, all of the tube banks of other devices in the art can be replaced by one continuous enhanced conduit. In other applications, the heat transfer fluid flows through the enhanced conduit while the hot fluid flows along an outer surface of the enhanced conduit.

The High-Efficiency Enhanced Boiler (HEEB) of the present invention offers improvements over conventional designs. A first improvement is a continuous heat transfer relation by surrounding the enhanced conduit with heat transfer medium. A second improvement is the possibility of substantial turndown ratios. A third improvement is the feasibility of manufacturing devices for applications requiring steam pressures in excess of 21.4 atmospheres absolute, whereas conventional firetube boilers have practical limitations. Finally, the HEEB is readily configurable to generate superheated steam.

Therefore, a first objective of the present invention is to provide a High Efficiency Enhanced Boiler capable of generating superheated steam or steam/hot water output. A second objective of the present invention is to provide an effective method for direct-fire or indirect-fire heat transfer to a molten metal heat transfer medium. A third objective of the present invention is to provide a High Efficiency Enhanced Boiler for "waste heat recovery" or indirect-fired boiler applications. A fourth objective of the present invention is to provide a boiler with an enhanced conduit capable of removing heat from the burner flame by proximally located fins.

A first aspect of the invention is directed toward a device for transferring heat from a fluid to a heat transfer medium comprising a vessel for containing the heat transfer medium, a conduit extending through a wall of the vessel, the conduit having a first surface in contact with the heat transfer medium and a second surface in contact with a fluid within the conduit, and a plurality of fins, each fin extending through a wall of the conduit, contacting the heat transfer medium and the fluid, wherein heat is transferred from the fluid to the heat transfer medium via the plurality of fins.

A second aspect of the invention is directed toward a device for transferring heat from a fluid to a heat transfer medium comprising a vessel containing the heat transfer medium, a conduit extending through a wall of the vessel, the conduit having a first surface in contact with the heat transfer medium and a second surface in contact with a fluid within the conduit, and at least one tube, wherein the heat transfer medium flows within the tube and the fluid flows around the tube.

A third aspect of the invention is directed toward a device for transferring heat from a fluid to a heat transfer medium comprising a vessel containing the heat transfer medium, a first conduit extending through a wall of the vessel, the first conduit having a first surface in contact with the heat transfer medium and a second surface in contact with a fluid within the first conduit, a plurality of fins, each fin extending through a wall of the first conduit, wherein heat is transferred from the fluid to the heat transfer medium via the plurality of fins, and at least one tube, wherein the heat transfer medium flows within the tube and the fluid flows around the tube, and wherein heat is transferred from the fluid to the heat transfer medium via the tube.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

Figure 3:
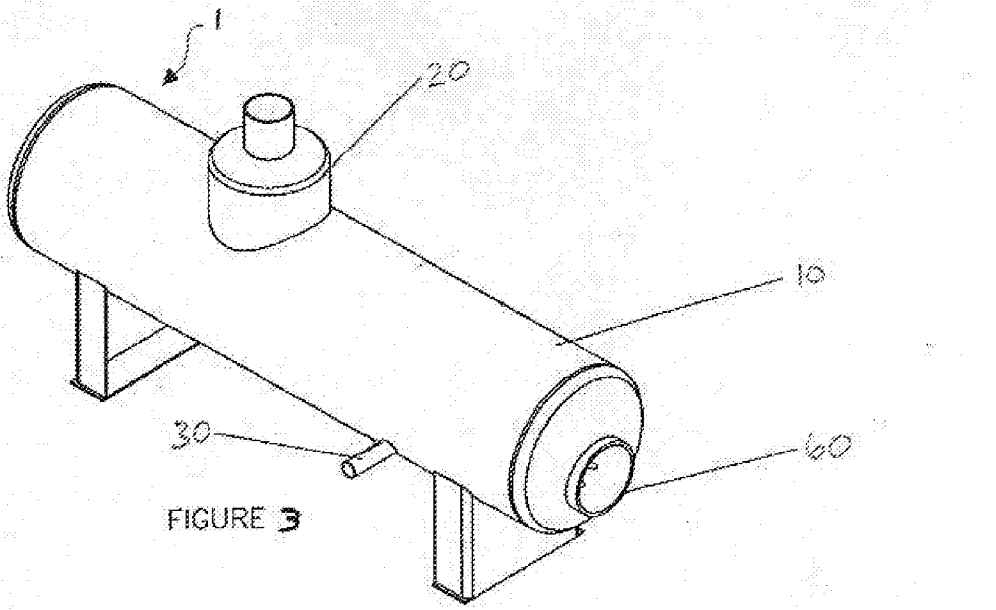
FIG. 3 shows a side elevational view of one embodiment of the invention.
Figure 2:
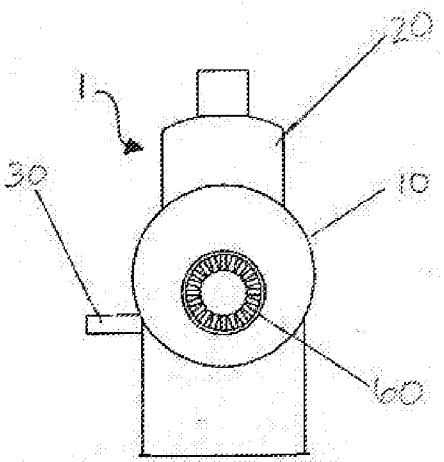
FIG. 2 shows a front-view of one embodiment of the invention.
Figure 1:
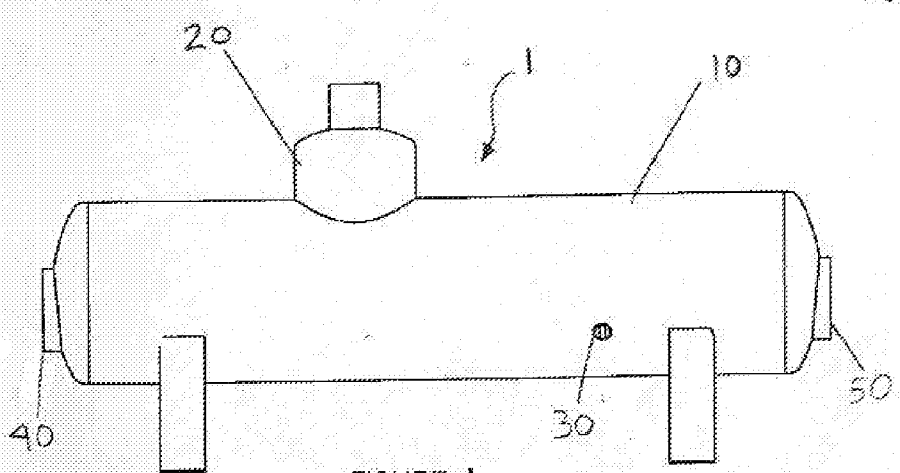
FIG. 1 shows a side-view of one embodiment of the invention.

FIGS. 1 through 6 depict a boiler 1 of the present invention, which includes a vessel 10 for containing a heat transfer medium. In some embodiments, vessel 10 is pressurized internally and designed according to American Society of Mechanical Engineers (ASME) codes for boilers and pressure vessels. The ASME codes are one of a few fabrication standards honored worldwide. Typically, internal design pressures for this class of vessel range from 1.1 to 21.4 atmospheres absolute, although there are vessels in existence that exceed pressures of 21.4 atmospheres absolute. For reasons of safety and reliability, the ASME codes and others restrict the materials and fabrication methods for vessels with internal design pressures over 2.0 atmospheres absolute. Therefore, only code recognized materials, such as, but not limited to, SA516 GR70, SA240 304, SA312 TP304, and SA106 B, are acceptable for fabrication of vessel 10. In addition, the adherence to a Code infers that only a facility skilled in the art can fabricate a device such as vessel 10. Additionally, insulation (not shown) covers the exterior surface of vessel 10 for reasons of efficiency and safety.

Four basic penetrations are commonly made to vessel 10. In actuality, and commonly known to those of ordinary skill in the art, several penetrations of vessel 10 are required. Process and policy require penetrations for boiler inspection, boiler drainage, pressure relief, and sensing/gauging. Although the previously mentioned compulsory penetrations are not shown, it is assumed that these requirements are met in the final or code-authorized design.

The sump 20 proximal to the top of vessel 10 is indicative of a steam boiler. By design, sump 20 is known to moderate surging, a problem associated with steam production. Consequently, in order to maintain a sufficient level of a heat transfer medium (e.g., water in the case of a steam boiler), a feedwater inlet 30 is located near the bottom of vessel 10. Any steam having left sump 20 continues upstream to deliver the stored energy and then returns downstream as condensate to feedwater inlet 30, thus completing the cycle. This process is typical of a closed steam/water system. In reality, system losses require that provisions be made to replenish the heat transfer medium (e.g., make-up water). Furthermore, deaerators and water treatments are meant to protect the system components from oxidation and chemical attack. However, since deaeraters and chemical treatments are known to those of ordinary skill in the art, further explanation will not be given.

The final two penetrations shown in the vessel 10 are the hot fluid inlet 40 and the flue outlet 50 of enhanced conduit 60. Situated entirely within vessel 10, enhanced conduit 60 forms a non-communicating pressure boundary between a hot fluid contained within it and a heat transfer medium within vessel 10. Thus, enhanced conduit 60 is entirely in heat transfer relation with the hot fluid and the heat transfer medium. Often, the hot fluid is hot air generated from a burner, although other fluids or liquids may be used. For example, it may be desirable to cool a molten metal or salt. In such a situation, the molten meal or salt may be passed through enhanced conduit 60, transferring its heat to a heat transfer medium.

Similarly, although the embodiments of the invention are often depicted as steam boilers, necessitating that the heat transfer medium be water, other fluids or liquids are also allowable. For example, the heat transfer medium may be any liquid, gas, or similar material with suitable heat transfer properties.

Figure 6:
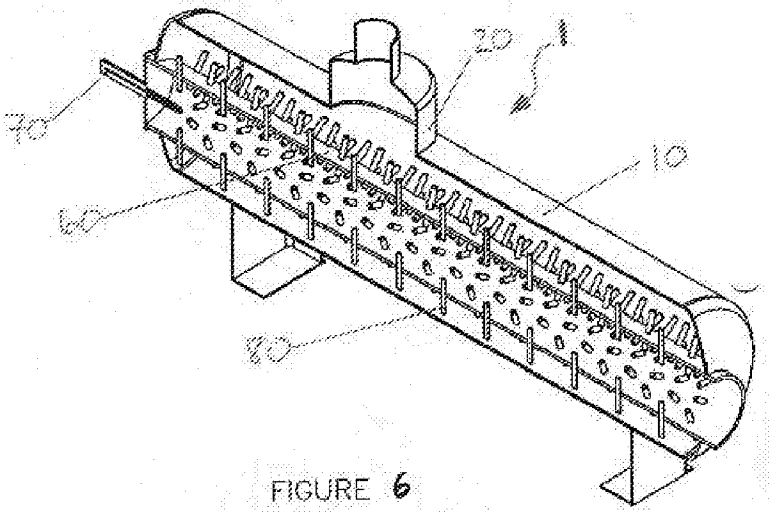
FIG. 6 shows a side elevational view of the device of FIG. 4.
Figure 5:
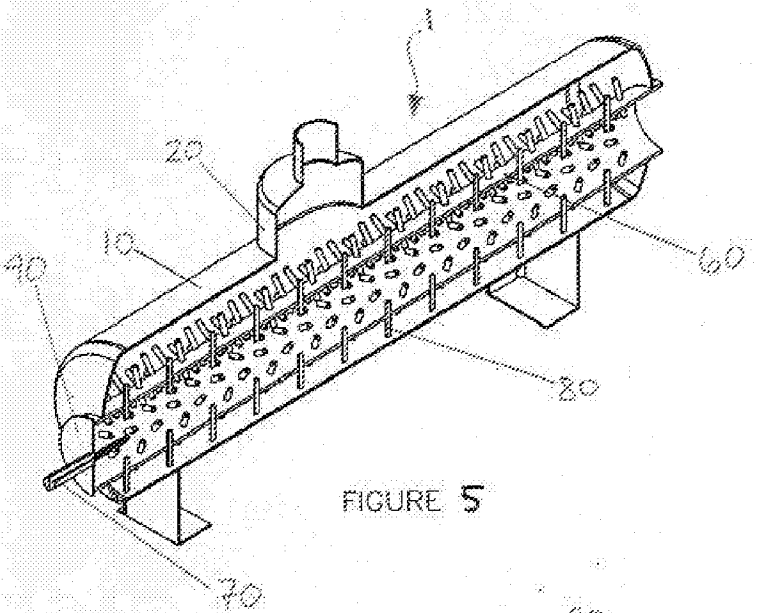
FIG. 5 shows a side elevational view of the device of FIG. 4.
Figure 4:
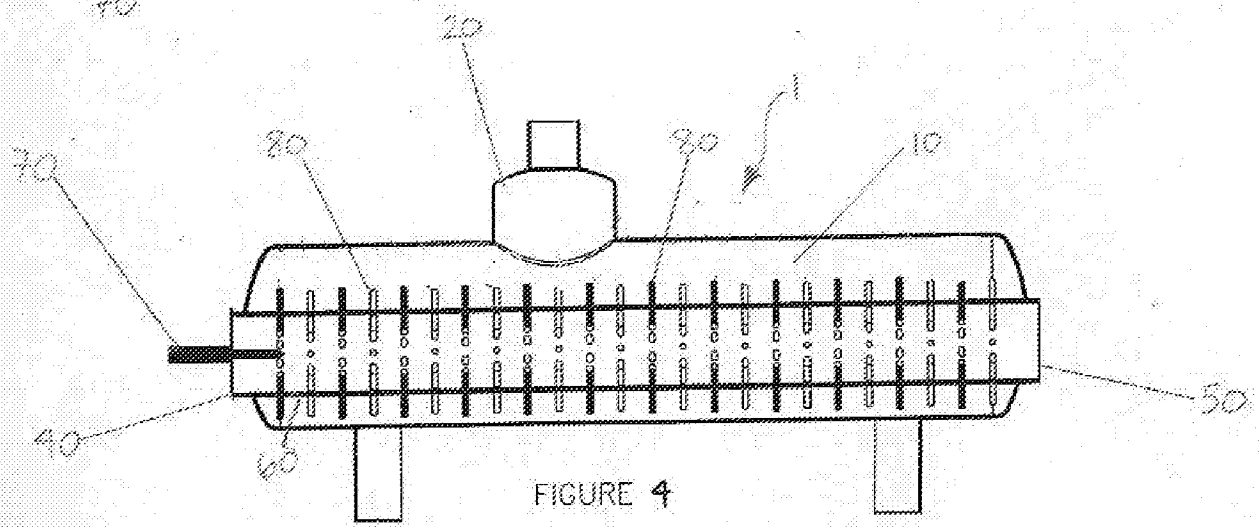
FIG. 4 shows a cross-sectional view of one embodiment of the invention.
Figure 9:
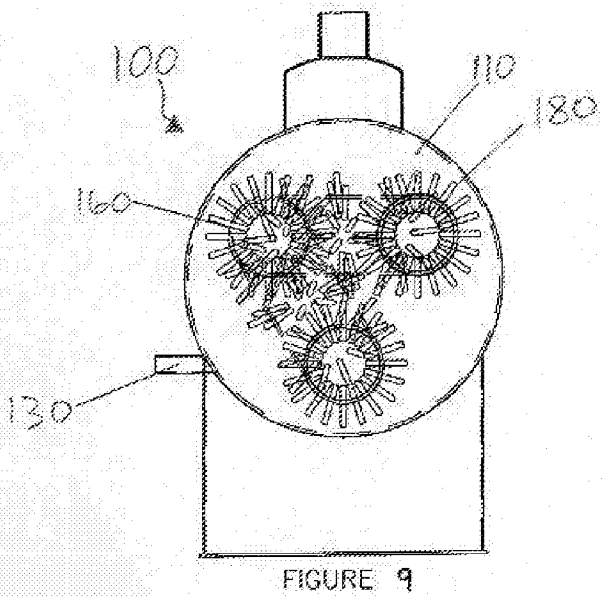
FIG. 9 shows a front-view of the device of FIG. 7.
Figure 8:
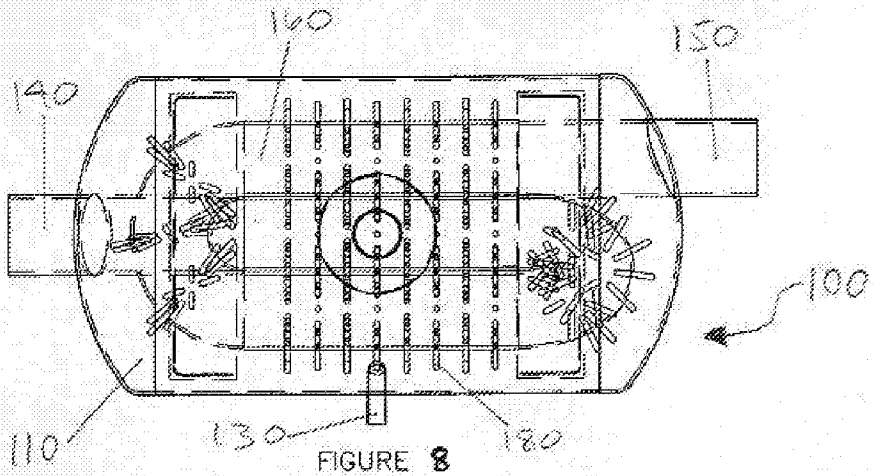
FIG. 8 shows a top-view of the device of FIG. 7.
Figure 7:
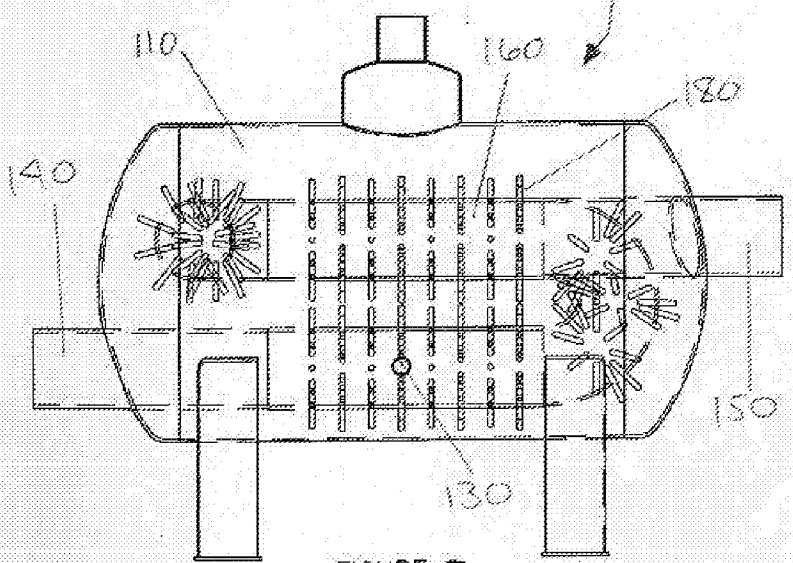
FIG. 7 shows a cross-sectional view of one embodiment of the invention.
Figures 10, 11, 12:
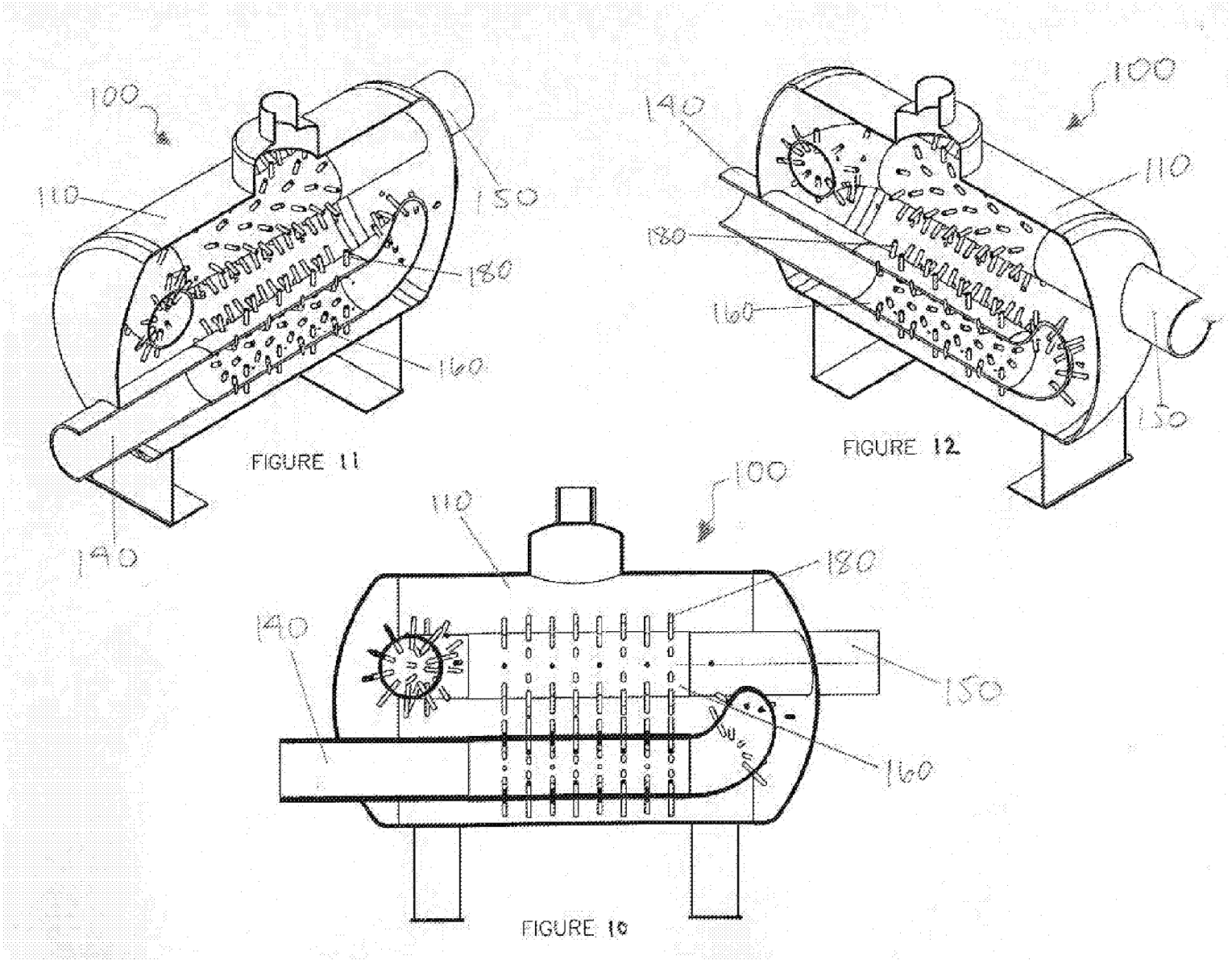
FIG. 10 shows a cross-sectional view of one embodiment of the invention.
FIG. 11 shows a side elevational view of the device of FIG. 10.
FIG. 12 shows a side elevational view of the device of FIG. 10.
Figure 14:
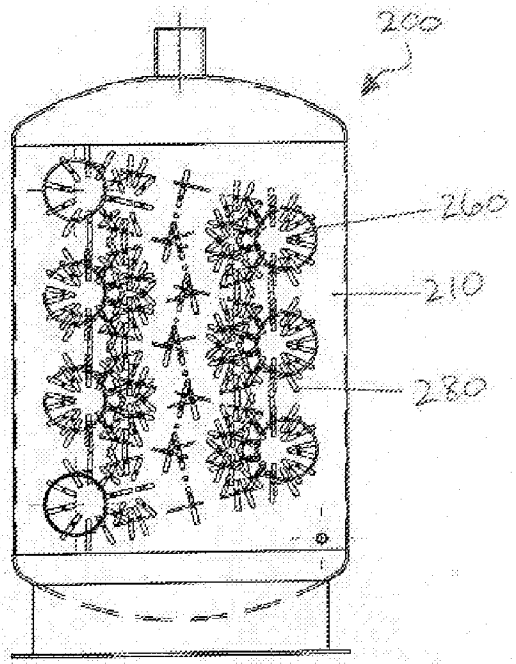
FIG. 14 shows a cross-sectional view of one embodiment of the invention.
Figure 15:
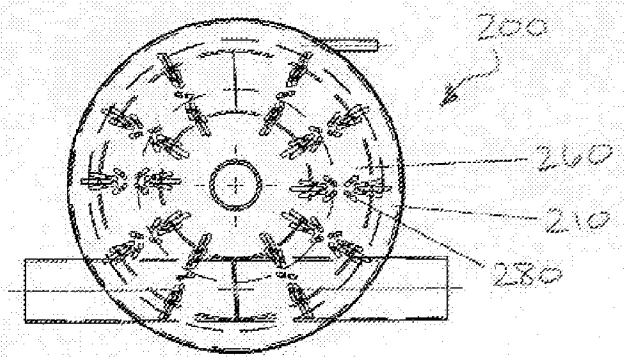
FIG. 15 shows a top view of the device of FIGS. 13 and 14.
Figure 13:
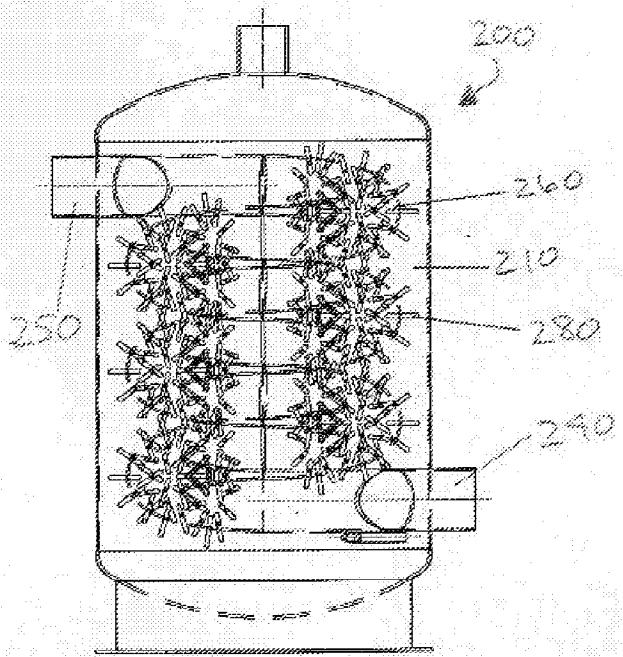
FIG. 13 shows a cross-sectional view of one embodiment of the invention.
Figure 18:
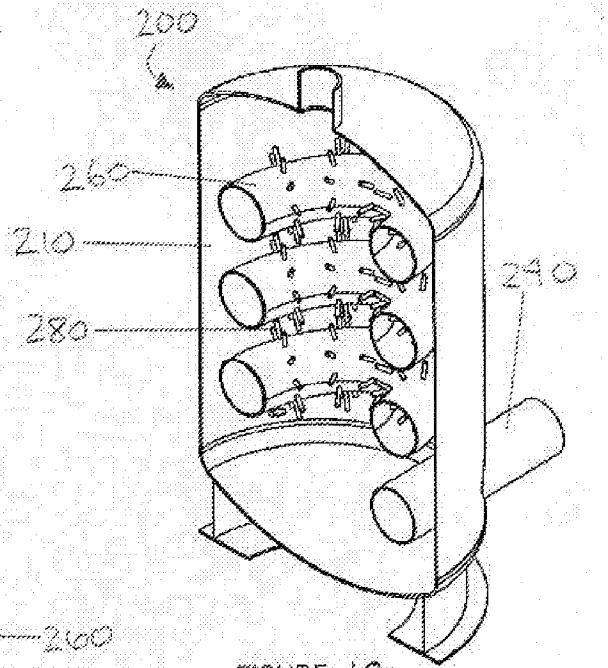
FIG. 18 shows a side elevational view of the device of FIG. 16.
Figure 16:
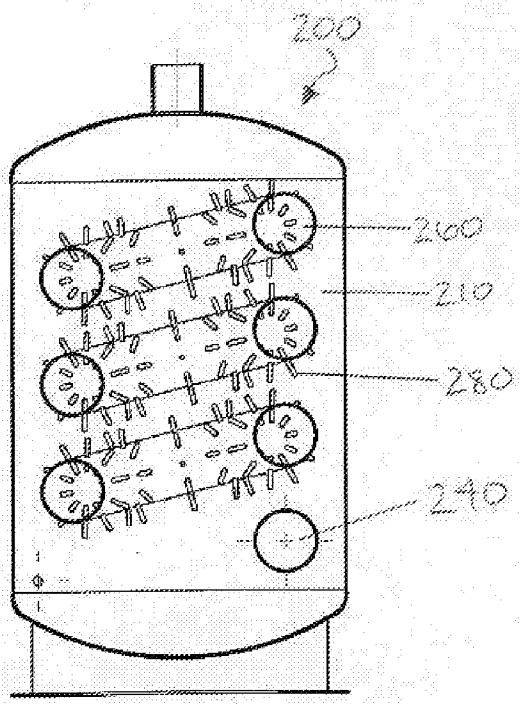
FIG. 16 shows a cross-sectional view of one embodiment of the invention.
Figure 17:
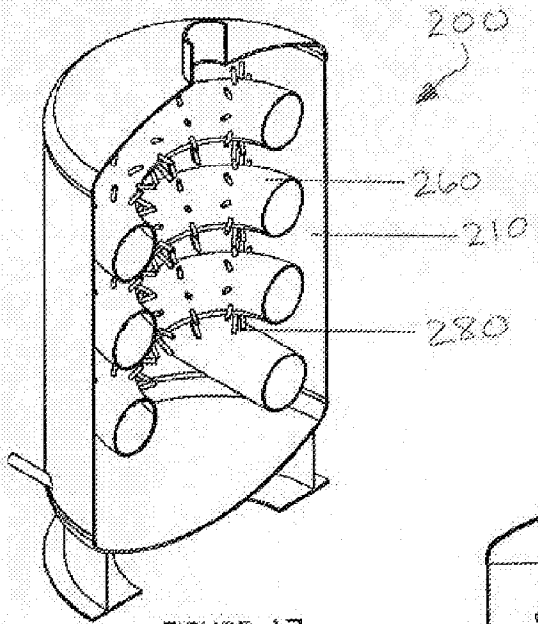
FIG. 17 shows a side elevational view of the device of FIG. 16.

In a "single pass firetube boiler," enhanced conduit 60 extends horizontally near a central axis of vessel 10, as shown in FIGS. 4 through 6. A fuel-fired burner 70, generates heat and energy, which are forced into enhanced conduit 60. Burner fuel may include, for example, coal, distillate oil, natural gas, methanol, ethanol, propane, and liquefied petroleum gas. A forced draft subassembly (not shown) regulates the flow of gas to burner 70 so that the proper ratio of oxygen-to-fuel can be attained, and forces or drives the hot gas into enhanced conduit 60.

Essentially, enhanced conduit 60 is under the same pressure as vessel 10, except that the pressure is exerted on an internal surface of vessel 10 and an external surface of enhanced conduit 60. Once again, the ASME code or other accepted design standard is invoked to comply with engineering requirements. In general, with respect to the length of enhanced conduit 60, external pressure is more severe than internal pressure in terms of local stress. Generally, when external pressure applied to a conduit exceeds allowable stress limits, buckling or failure occurs. Accordingly, in one embodiment of the invention, the cross-sectional geometry of enhanced conduit 60 is circular. However, other shapes, including but not limited to square, rectangular, or ellipsoidal, are possible and within the scope of the present invention.

Within enhanced conduit 60, a plurality of fins 80 extend intimately into the path of the hot fluid. Fins 80 establish a series of obstructions that force the hot fluid to assume a path around individual fins 80 in a manner that elicits turbulence, thereby enhancing heat transfer. Furthermore, a portion of each fin 80 extends through a wall of enhanced conduit 60 and contacts the heat transfer medium. Fins 80 thereby increase heat transfer through turbulent mixing of the hot fluid and by increasing the surface area exposed to the hot fluid and/or the heat transfer medium. Each fin 80 may be oriented through a wall of enhanced conduit 60 in any number of angles relative to the long and short axes of enhanced conduit 60. As such, fins 80 may be oriented to direct the flow of the hot fluid and/or the heat transfer medium along a particular path.

Each fin 80 is fabricated from materials that demonstrate structural stability while providing good heat transfer characteristics. Possible fin 80 materials include, but are not limited to, generic steels, metals (including copper, molybdenum, etc.), ceramics, refractory materials, and engineered composites. A largely material-dependent objective of the present invention is the ability to extract heat by placing fins 80 in close proximity to the flame of burner 70. One example (not shown) of a fin configuration capable of meeting this objective comprises a cylindrical generic steel body fitted with a spherical molybdenum tip.

For simplicity in depiction, cylindrical-shaped fins 80 are shown. However, other fin shapes or combinations of shapes are possible and considered to be within the scope of the present invention. Such shapes include, for example, square, elliptical, aerodynamic, rectangular, and spherical. In addition, such fins may be constructed with through holes, with threaded holes, with blind holes, and may be tapered or threaded. As an example (not shown) of a multi-geometric combination, the fin shape may be cylindrical at one end, tapered in the middle, and rectangular with blind holes toward its opposite end. Each fin 80 may be mechanically fastened to enhanced conduit 60 in an ASME code or other acceptable method, forming a pressure-rated joint.

In general, the heat transfer medium is water/steam, although molten metal (heat transfer salt) and hot oil systems are possible. As suggested earlier, widespread availability and substantial heat capacity are factors favoring water/steam as the most common heat transfer medium. At startup, vessel 10, around the outside surface of enhanced conduit 60, is filled with the heat transfer medium (e.g., water). Demand for steam signals burner 70 to ignite fuel into a combustible flame. The flame is directed at hot fluid inlet 40 of enhanced conduit 60, whereby heat is drawn off by fins 80 located near the outer flame boundary. Fins 80 extract substantial energy from the flame by radiation/conduction/convection heat transfer to the heat transfer medium over the length of the flame. At the extreme boundary of combustion, where the flame ceases to exist, fins 80 remove heat from the hot fluid stream by convection/conduction couples. Additionally, the portion of each fin 80 extending within enhanced conduit 60 causes turbulence in the hot fluid stream, accelerating convection heat transfer, while the portion of each fin 80 extending outside enhanced conduit 60 provides more surface area for convective heat transfer to occur. More particularly, a balanced energy flow exists in the region of each fin 80. The exhausted hot gas leaves enhanced conduit 60 through the flue outlet 50 on route to the stack (not shown). As the heat transfer medium (e.g., water) is heated, it evaporates and exits at sump 20. From sump 20, the steam goes to the load (not shown), where condensation occurs. The steam condenses to water and is pumped into inlet 30 in order to maintain a constant level of heat transfer medium within boiler 1.

EXAMPLE 1

Referring to FIGS. 7-12, a direct-fired 3-pass 30-horsepower boiler 100 is shown, fabricated in accordance with the present design criteria for a pressure of 10 atmospheres and requiring a one million BTU (British thermal units) natural gas burner. Cylindrical vessel 110 has dimensions of 42-inches O.D. wide by 60-inches O.D. long, with ten-inch diameter enhanced conduit 160 winding through the interior of the vessel. Hot fluid enters boiler 100 through hot fluid inlet 140, passes through enhanced conduit 160, and exits through flue outlet 150. Condensate returns to boiler 100 through feedwater inlet 130. There are 280 ¾" diameter fins 180 located circumferentially throughout enhanced conduit 160 in sets of ten. Fins 180 are mechanically fastened to enhanced conduit 160 by virtue of a self-locking taper and seal welding. The temperature of the exhausted flue gas is approximately 230° C. The thermal efficiency of such a design is increased, in part, due to the fact that "turn-around passes" are maintained in heat transfer relationship with the heat transfer medium within the boiler.

EXAMPLE 2

Referring now to FIGS. 13-18, a direct-fired boiler 200 is shown with a coiled enhanced conduit 260. The long axis of cylindrical vessel 210 is oriented vertically, rather than horizontally as in Example 1. Rather than completing a series of reversals in direction as in Example 1, enhanced conduit 260 is coiled within vessel 210, completing a total of three revolutions. Hot fluid enters boiler 200 through hot fluid inlet 240, passes through enhanced conduit 260, and exits through flue outlet 250. As in Example 1, enhanced conduit 260 contains a plurality of fins 280 located around its circumference and along its length. Fins 280 may be fastened to enhanced conduit 260 by any of a number of means described above.

EXAMPLE 3

Figure 19:
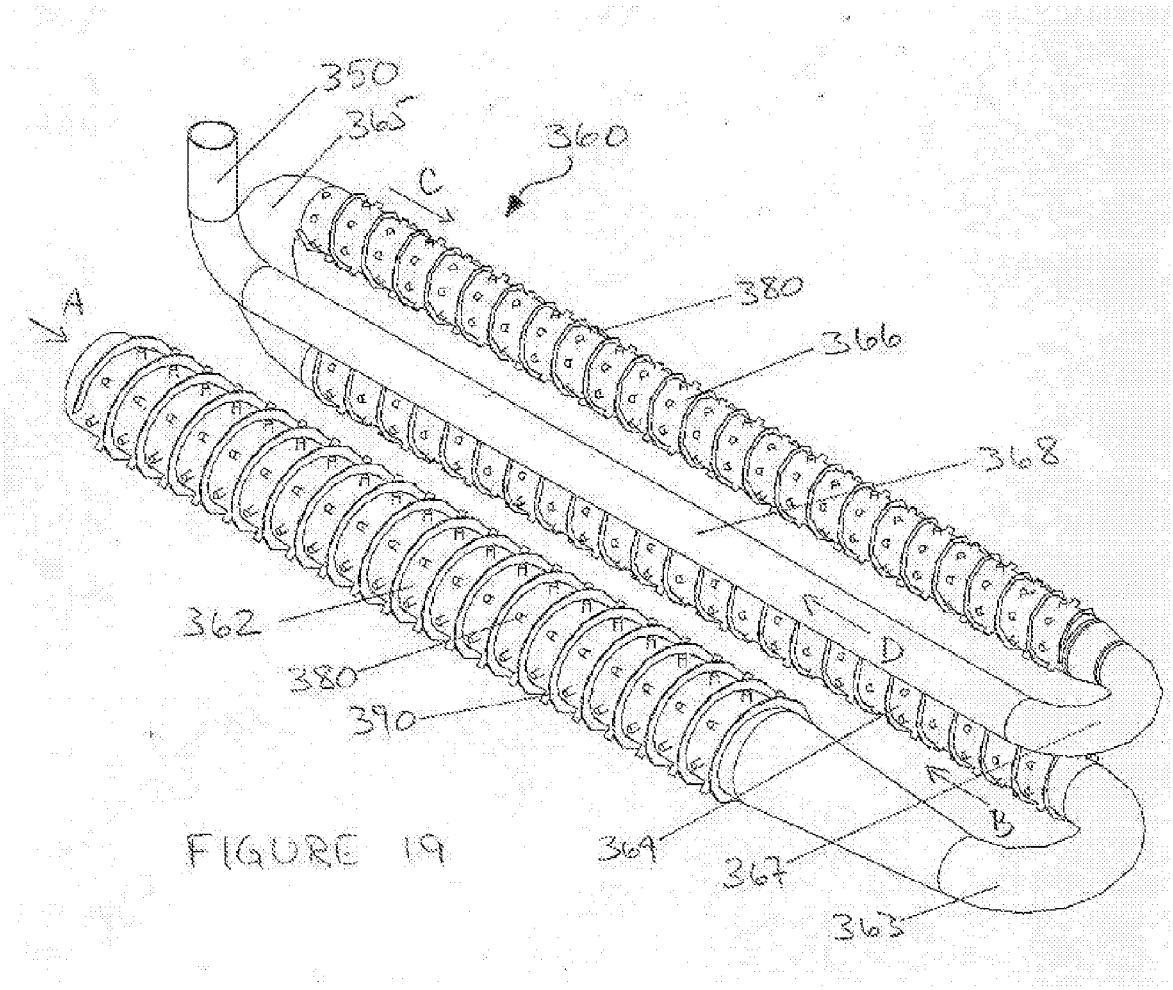
FIG. 19 shows a side elevational view of an enhanced conduit apparatus according to the invention.
Figure 20:
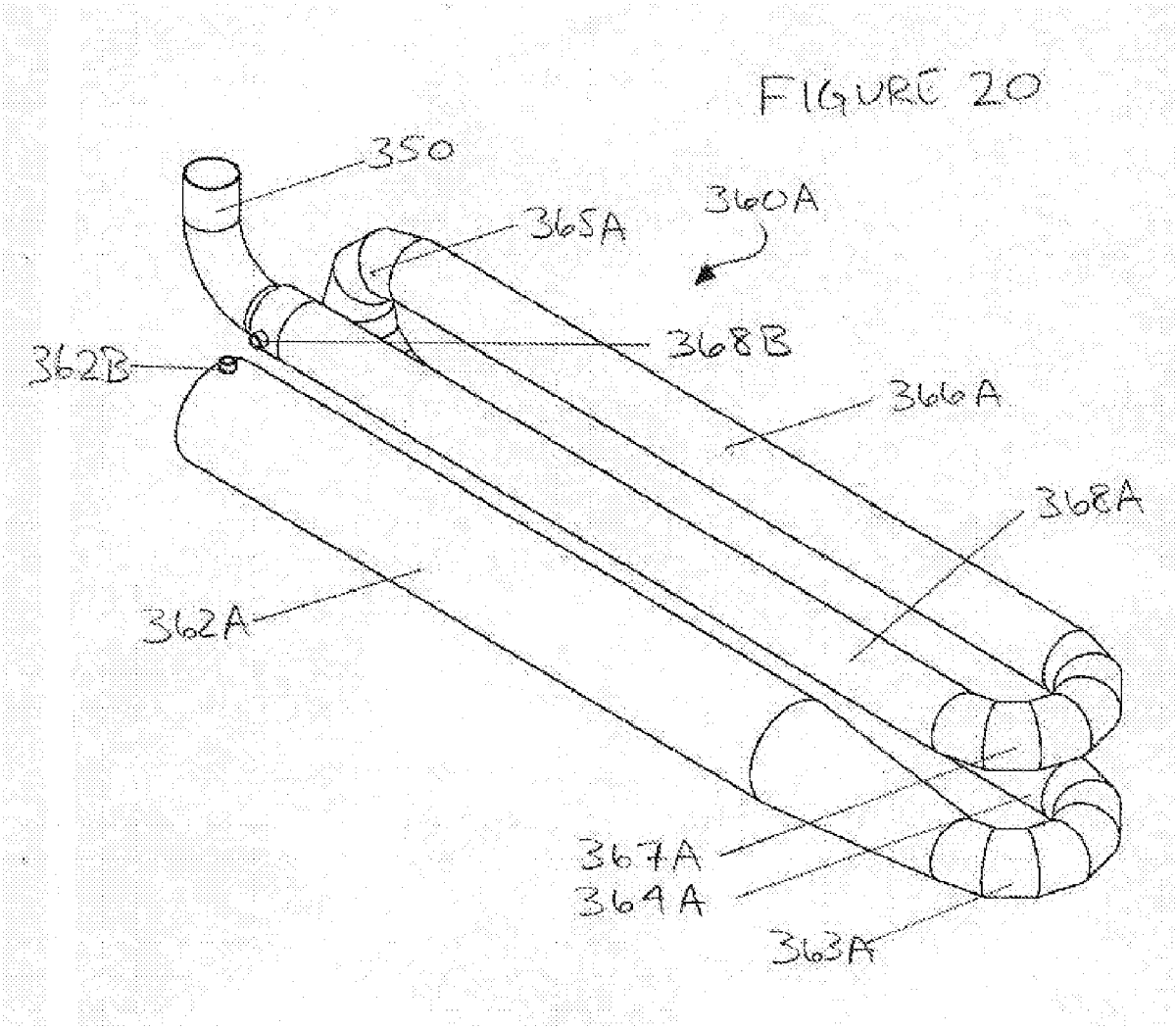
FIG. 20 shows a housing enclosing the apparatus of FIG. 19.
Figure 21:
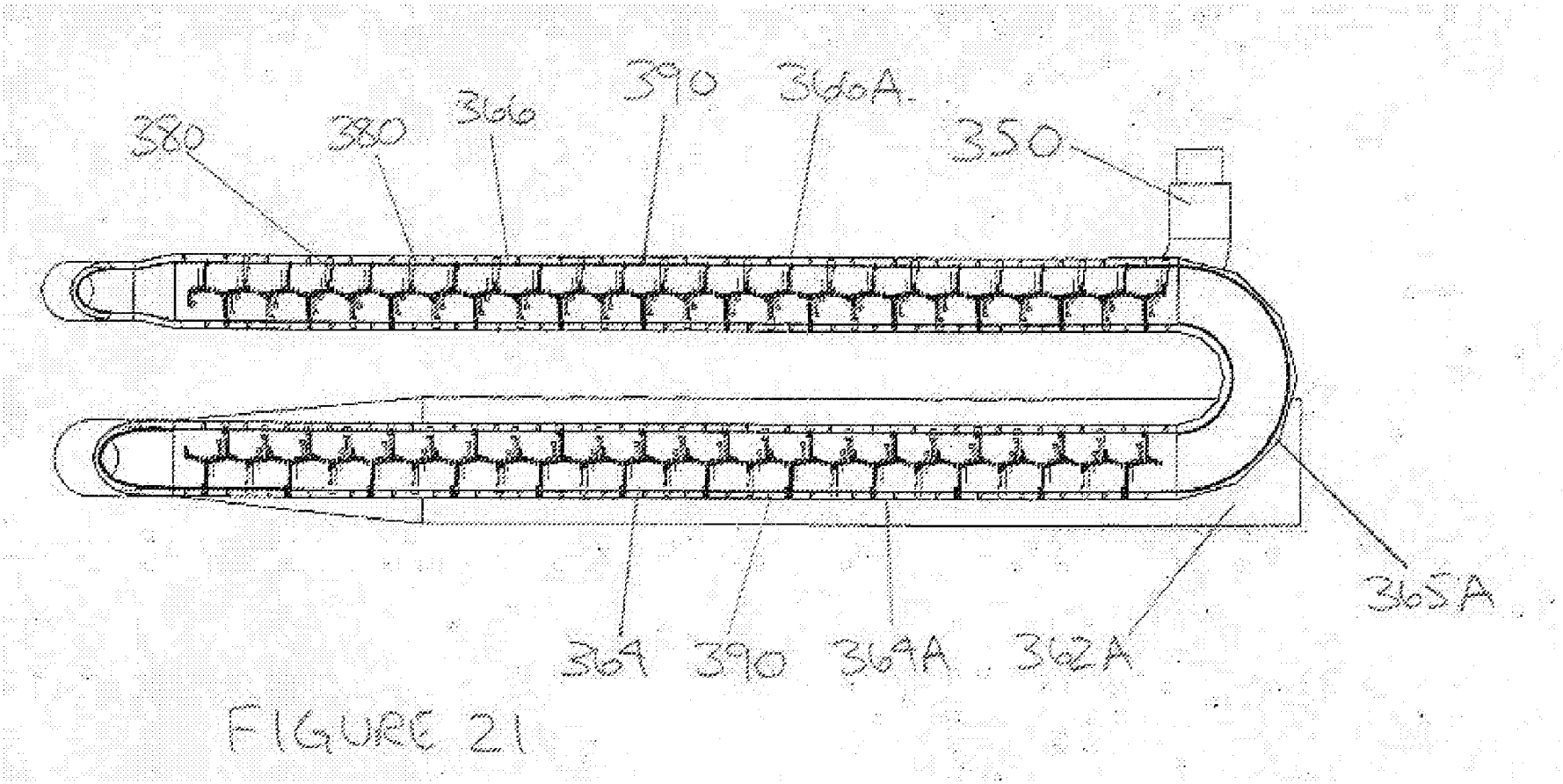
FIG. 21 shows a cross-sectional view of the apparatus of FIG. 19.

Referring to FIGS. 19-21, a 4-pass conduit 360 is shown. Unlike earlier-described embodiments, wherein a heat transfer medium sits within a vessel, the depicted embodiment incorporates a housing 360A around the apparatus 360. Housing 360A directs a heat transfer medium along an outer surface of a pass 362, 364, 366, 368 as the hot fluid is directed along an inner surface of the same pass. In some embodiments, such as that shown in FIG. 20, the apparatus has a "reverse flow," wherein as the hot fluid enters first pass 362 (often a firetube), the heat transfer medium enters through a heat transfer medium inlet 368B at a distal end of the fourth pass housing 368A, flows in a direction substantially opposite that of the hot fluid, and exits through a heat transfer medium outlet 362B at a proximal end of the first pass housing 362A.

In the embodiment depicted in FIG. 19, three of the four passes 362, 364, 366 are enhanced, each containing a plurality of fins 380 extending through a wall of the pass. Optionally, one or more enhanced pass 362, 364, 366 may contain a helical member 390 along its outer surface. Located in such a manner, helical member 390 contacts or resides close to an inner surface of each enhanced pass housing 362A, 364A, 366A of apparatus housing 360A and directs the heat transfer medium along the surface of the pass 362, 364, 366, effectively increasing contact between the pass and the heat transfer medium. Accordingly, in order to increase contact between fins 380 and the heat transfer medium, helical member 390 preferably lies parallel to the pattern of fins 380. Such an arrangement effectively creates channels between the surface of a pass 362, 364, 366 and a pass housing 362A, 364A, 366A, in which are situated a plurality of fins 380.

Each pass 362, 364, 366, 368 is connected to another by a turn-around pass 363, 365, 367 which substantially reverses the direction of flow of the fluid within enhanced conduit 360. For example, the fluid within enhanced conduit 360 initially flows through first pass 362 in direction A. Upon passage through first turn-around pass 363, the fluid substantially reverses direction, entering second pass 364 in direction B. Similarly, upon passage through second turn-around pass 365, the fluid again substantially reverses direction, entering third pass 366 in direction C. Finally, the fluid passes through third turn-around pass 367 and enters a non-enhanced pass 368 in direction D before flowing through flue outlet 350.

FIG. 21 shows a side cross-sectional view of the apparatus in order to depict the obstructions within each enhanced pass 364, 366 created by the interior projections of fins 380. Also depicted are the channels created between helical member 390 and enhanced pass housings 364A, 366A.

As depicted, only passes 362, 364, 366 contain fins 380 and, optionally, helical member 390. However, it should be recognized that turn-around passes 363, 365, 367 may be enhanced with fins 380 and/or helical member 390 in addition to or instead of passes 362, 364, 366.

EXAMPLE 4

Figure 22:
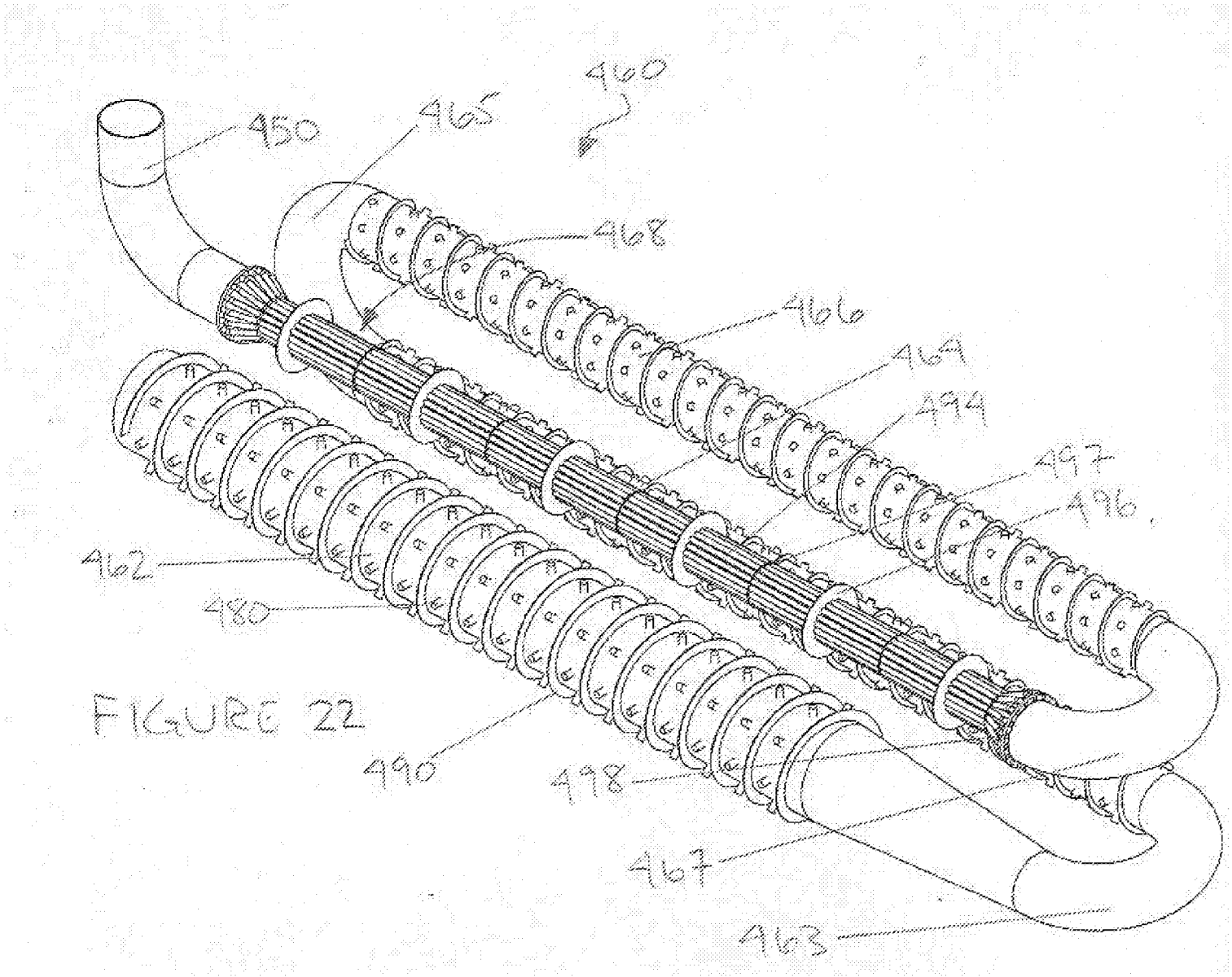
FIG. 22 shows a side elevational view of an alternate embodiment of an enhanced conduit apparatus according to the invention.
Figure 23:
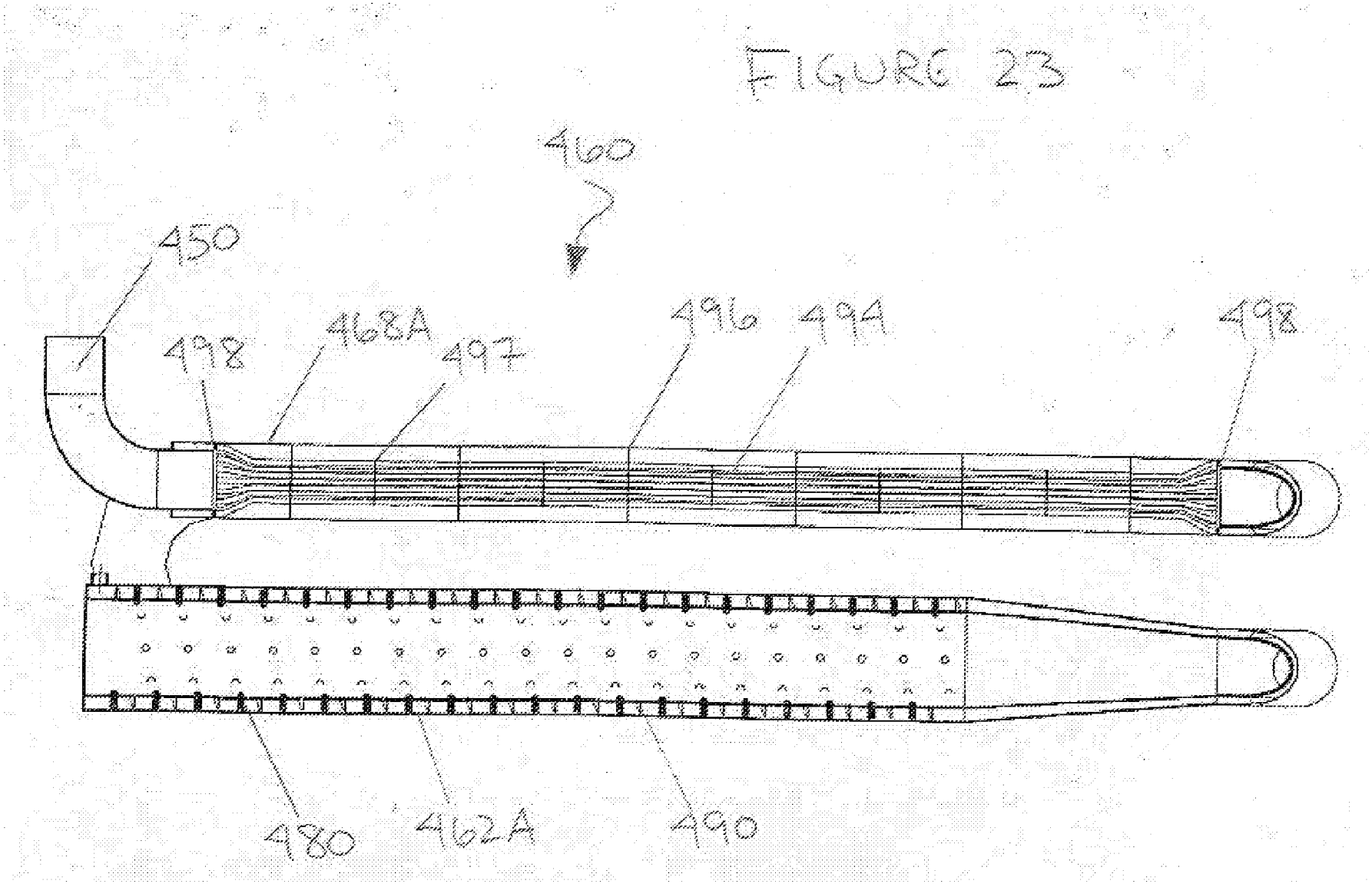
FIG. 23 shows a side cross-sectional view of the apparatus of FIG. 22.
Figure 24:
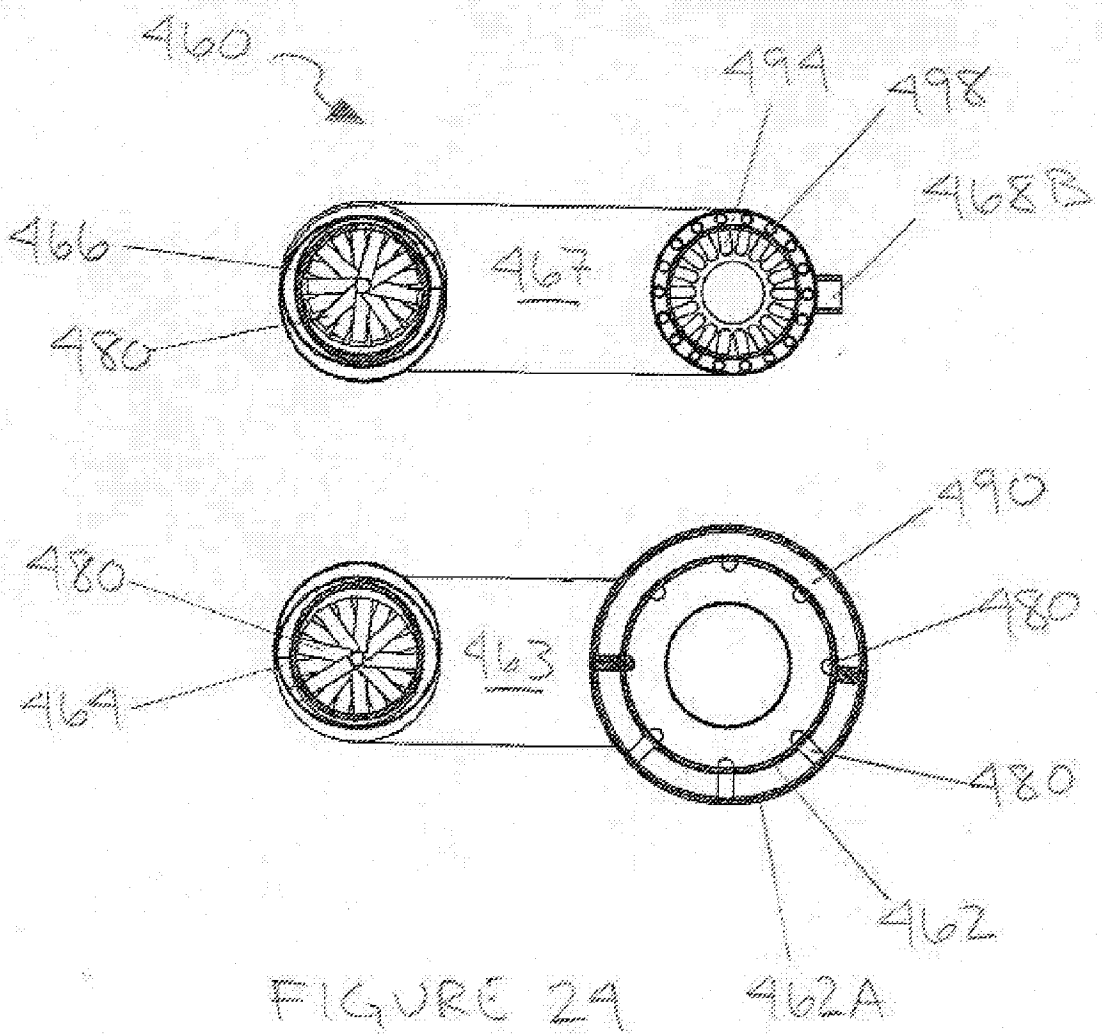
FIG. 24 shows a front cross-sectional view of the apparatus of FIG. 22.

Referring to FIGS. 22-24, a modified 4-pass enhanced conduit 460 is shown. Unlike the device in FIG. 19, wherein fourth pass 368 is an unenhanced conduit, modified enhanced conduit 460 includes a fourth pass 468 comprised of a plurality of tubes 494. The plurality of tubes 494 is preferably arranged in a circular pattern, as depicted most clearly in FIG. 24, although other shapes are allowable. Similarly, while a plurality of tubes 494 is depicted, a single tube is also within the scope of the invention.

Heat transfer medium enters an opening 498 in an end of each tube 494 and flows through tube 494, increasing the heat transfer from the hot fluid within fourth pass 468 to the heat transfer medium. Due to the transfer of heat from the hot fluid to the heat transfer medium, the difference in temperature between the hot fluid and the heat transfer medium is generally smaller along fourth pass 468 than along earlier passes 462, 464, 466. Where such a smaller temperature difference exists, it has been found that such a plurality of tubes more efficiently transfers heat from the hot fluid to the heat transfer medium than does a plurality of fins 480 or a plurality of fins 40 and helical members 490, such as those along earlier passes 462, 464, 466.

Optionally, one or more baffles 496, 497 may be placed along the length of the plurality of tubes 494. Such baffles may be outer baffles 496, located around tubes 494, or inner baffles 497, located within the plurality of tubes 494. Outer baffles 496 are preferably ring shaped so as to fit around a circular arrangement of the plurality of tubes 494, although other shapes are allowable. Outer baffles 496 preferably contact or reside close to an inner surface of fourth pass housing 468A. Inner baffles are preferably disc shaped so as to fit within a circular arrangement of the plurality of tubes 494, although other shapes are allowable. Outer baffles 496 and inner baffles 497 disrupt the flow of the hot fluid within pass 468. Inner baffles 497 force the hot fluid outside the plurality of tubes 494 to a location between the plurality of tubes 494 and fourth pass housing 468A, while outer baffles 496 force the hot fluid in the opposite direction, i.e., into the center of the plurality of tubes 494. This disruption of the flow of the hot fluid increases heat transfer from the hot fluid to the heat transfer medium.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A device for transferring heat from a fluid to a heat transfer medium comprising:

a vessel capable of containing the heat transfer medium;

a conduit extending through a wall of the vessel, the conduit having a first surface for contacting the heat transfer medium and a second surface for contacting a fluid within the conduit;

a helical member residing around and along a length of the first surface of the conduit capable of angularly directing a flow of the heat transfer medium along the first surface of the conduit; and a plurality of fins helically arranged adjacent the helical member, each fin extending through a wall of the conduit, thereby being capable of contacting the heat transfer medium and the fluid, the helical arrangement of the plurality of fins being capable of imparting an angular flow to the fluid, wherein heat is transferred from the fluid to the heat transfer medium via the plurality of fins.

2. The device of claim 1, wherein the fluid is selected from a group consisting of a gas, a liquid, a molten salt, and a molten metal.

3. The device of claim 1, wherein the fluid is the product of an exothermic reaction.

4. The device of claim 1, wherein the heat transfer medium is selected from a group consisting of a liquid and a gas.

5. The device of claim 4, wherein the heat transfer medium is water.

6. The device of claim 1, comprising a plurality of conduits.

7. The device of claim 1, wherein at least one of the plurality of fins is oriented at an angle relative to the longitudinal and radial axes of the conduit.

8. The device of claim 1, wherein at least one of the plurality of fins contains structures on its surface to increase turbulence in at least one of the fluid and the heat transfer medium.

9. The device of claim 8, wherein increased turbulence in at least one of the fluid and the heat transfer medium results in increased heat transfer between the fluid and the heat transfer medium.

10. The device of claim 1, wherein the helical arrangement of the plurality of fins is capable of directing the flow of the fluid toward the second surface of the conduit.

11. A device for transferring heat from a fluid to a heat transfer medium comprising:

a vessel capable of containing the heat transfer medium;

a conduit extending through a wall of the vessel, the conduit having a first surface for contacting the heat transfer medium and a second surface for contacting a fluid within the conduit;

a helical member residing around and along a length of the first surface of the conduit capable of angularly directing a flow of the heat transfer medium along the first surface of the conduit;

a plurality of fins helically arranged adjacent the helical member, each fin extending through a wall of the conduit, thereby being capable of contacting the heat transfer medium and the fluid, the helical arrangement of the plurality of fins being capable of imparting an angular flow to the fluid, wherein heat is transferred from the fluid to the heat transfer medium via the plurality of fins; and at least one tube, wherein the heat transfer medium flows within the tube and the fluid flows around the tube, and wherein heat is transferred from the fluid to the heat transfer medium via the tube.

12. The device of claim 11, further comprising at least one baffle for interrupting the flow of the fluid around the tube.

* * * * *

UNITED STATES PATENT AND TRADEMARK OFFICE

CERTIFICATE OF CORRECTION

PATENT NO. : 7,413,004 B2
APPLICATION NO. : 11/276368
DATED : August 19, 2008
INVENTOR(S) : John E. Okonski, Jr. and John E. Okonski, Sr.

It is certified that error appears in the above-identified patent and that said Letters Patent is hereby corrected as shown below:

Delete:
"John E. Okonski, Sr., 2323 Alton St., Niskayuna, NY (US) 12309 John E. Okonski, Jr., 2323 Alton St., Niskayuna, NY (US) 12309"

Insert:
-- John E. Okonski, Jr., 2122 Primrose La., Niskayuna, NY (US) 12309 John E. Okonski, Sr., 2122 Primrose La., Niskayuna, NY (US) 12309 --

Signed and Sealed this

Thirtieth Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,413,004 B2
APPLICATION NO. : 11/276368
DATED : August 19, 2008
INVENTOR(S) : John E. Okonski, Jr. and John E. Okonski, Sr.

It is certified that error appears in the above-identified patent and that said Letters Patent is hereby corrected as shown below:

Item (76) Inventors,
Delete:
"John E. Okonski, Sr., 2323 Alton St., Niskayuna, NY (US) 12309 John E. Okonski, Jr., 2323 Alton St., Niskayuna, NY (US) 12309"

Insert:
-- John E. Okonski, Jr., 2122 Primrose La., Niskayuna, NY (US) 12309 John E. Okonski, Sr., 2122 Primrose La., Niskayuna, NY (US) 12309 --

This certificate supersedes the Certificate of Correction issued September 30, 2008.

Signed and Sealed this

Twenty-first Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,413,004 B2
APPLICATION NO. : 11/276368
DATED : August 19, 2008
INVENTOR(S) : John E. Okonski, Jr. and John E. Okonski, Sr.

It is certified that error appears in the above-identified patent and that said Letters Patent is hereby corrected as shown below:

Item (75) Inventors should read:

-- John E. Okonski, Jr., 2323 Alton St., Niskayuna, NY (US) 12309; John E. Okonski, Sr., 2122 Primrose La., Niskayuna, NY (US) 12309 --

This certificate supersedes the Certificate of Correction issued September 30, 2008.

Signed and Sealed this

Ninth Day of December, 2008

JON W. DUDAS
*Director of the United States Patent and Trademark Office*